US005484457A

United States Patent [19]

Schulze et al.

[11] Patent Number: 5,484,457

[45] Date of Patent: Jan. 16, 1996

[54] CONTINUOUS PRODUCTION OF SURFACE DYEINGS ON CELLULOSE FIBER TEXTILE MATERIALS

[75] Inventors: Joerg Schulze, Ludwigshafen; Harald Schlueter, Weisenheim; Kurt Bacher, Ludwigshafen; Wolfgang Schrott, Boehl-Iggelheim; Erich Kromm, Weisenheim, all of Germany

[73] Assignee: BASF Aktiengesellschaft, Ludwigshafen, Germany

[21] Appl. No.: 318,886

[22] PCT Filed: May 12, 1993

[86] PCT No.: PCT/EP93/01172

§ 371 Date: Oct. 31, 1994

§ 102(e) Date: Oct. 31, 1994

[87] PCT Pub. No.: WO93/23605

PCT Pub. Date: Nov. 25, 1993

[30] Foreign Application Priority Data

May 20, 1992 [DE] Germany ..... 42 16 591.1

[51] Int. Cl.[6] ..... C09B 62/00; D06P 5/00; D06P 3/66

[52] U.S. Cl. ..... 8/543; 8/567; 8/576; 8/584; 8/606; 8/614; 8/930; 8/188; 8/189; 8/196; 8/127.1; 8/554

[58] Field of Search ..... 8/116.1–127.1, 8/188, 554, 543–549, 567, 584, 576, 606, 614, 930

[56] References Cited

U.S. PATENT DOCUMENTS 4,579,559 4/1986 Canela ..... 8/127.1
5,015,754 5/1991 Dix et al. .

FOREIGN PATENT DOCUMENTS 3320629 8/1983 Germany .

*Primary Examiner*—Margaret Einsman
*Attorney, Agent, or Firm*—Oblon, Spivak, McClelland, Maier & Neustadt

[57] ABSTRACT

Process for the continuous production of surface dyeings on cellulose fiber textile materials, characterized in that the textile materials are treated with an aqueous liquor containing at least 5 g/l of benzyl halide quaternized condensation products of precondensates of trialkanolamines and ureas, cyclic carbonates and/or epihalohydrins and/or benzyl chloride quaternized condensation products of piperazine and epichloronydrin, and 0.02 to 1 g/l of a phosphoric triester whose alcohol component has 6 to 18 carbon atoms, the textile materials thus treated are then dyed in another bath with reactive dyes in an aqueous medium and the dyes are fixed by treatment with an alkaline aqueous liquor and the dyeing finished in conventional manner. The individual cellulose fibers of the textile material are not completely penetrated by the dye but, on the contrary, exhibit ring dyeing.

11 Claims, No Drawings

CONTINUOUS PRODUCTION OF SURFACE DYEINGS ON CELLULOSE FIBER TEXTILE MATERIALS

DESCRIPTION

The invention relates to a process for the continuous production of surface dyeings on cellulose fiber textile materials by treatment of the textile materials with an aqueous liquor containing cationic polyquaternary condensation products and phosphoric esters and subsequent dyeing of the textile materials with reactive dyes and finishing of the dyeings in conventional manner.

DE-A-3 320 629 discloses a process for dyeing cellulose fiber textile materials by initially producing on the textile materials a firmly adherent film by applying thereto water-soluble compounds containing primary and/or secondary basic amino groups, and (b) water-soluble compounds containing propylene chlorohydrin groups, the epoxides formed therefrom, water-soluble condensator containing N-methylol or N-methylol ether groups, then drying the textile material and dyeing it in conventional manner with reactive or acid dyes in an aqueous medium at pH values from 6 to 12. The dyeings thus obtainable correspond in terms of properties to an indigo dyeing. This process can be used to produce denim articles in all colors. As in indigo dyeing, in these denim dyeings the dyed warp of the denim fabric becomes lighter in color and more brilliant in shade on repeated washing.

U.S. Pat. No. 5 015 754 discloses quaternized condensation products obtainable by reaction of precondensates of trialkanolamines with carboxylic acid derivatives or epichlorohydrin and subsequent quaternization with benzyl chloride. These condensation products are used for after-treatment for the fixation of dyeings and prints on cellulose fiber textile materials.

The present invention has for its object to make available a process for the continuous production of surface dyeings on cellulose fiber textile materials.

This object is achieved according to the invention when the textile materials are initially treated with an aqueous liquor containing (i) at least 5 g/l of benzyl halide quaternized condensation products of precondensates of trialkanolamines and ureas, cyclic carbonates and/or epihalohydrins and/or benzyl chloride quaternized condensation products of piperazine and epichlorohydrin, and (ii)0.02 to 1 g/l of a phosphoric triester whose alcohol component derives from aliphatic, aryl-substituted aliphatic alcohols, phenols or alkyl-substituted phenols having in each case 6 to 18 carbon atoms in the alcohol or phenol radical, the textile materials thus treated are then dyed in another bath with reactive dyes in an aqueous medium and subsequently the dyes are fixed by treatment with an alkaline liquor in conventional manner and the dyeing finished.

The cellulose fibers of the textile materials thus dyed have been dyed not with complete penetration but only at the surface. These surface dyeings could also be referred to as ring dyeings. However, the textile material has been dyed level. Textile materials which can be dyed by the process of the invention are for example yarns, woven fabrics, knitted fabrics or nonwoven fabrics, which consist of cellulose fibers or contain them alone or in a blend with other fibers.

Preferably the process of the invention is used for dyeing cellulose fiber warp yarns.

The textile materials are initially treated with an aqueous liquor containing at least 5 g/l of benzyl halide-quaternized condensation products of precondensates of trialkanolamines and ureas, cyclic carbonates and/or epihalohydrins. Quaternized condensation products of this kind are described in detail in U.S. Pat. No. 5 015 754. The quaternized condensation products consist of A) a precondensate of one or more trialkanolamines of the general formula I

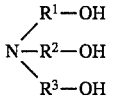

I where the radicals $R^1$ to $R^3$ are 1,2-alkylene groups having 2 to 4 carbon atoms, and B) 1 to 30 mol % per mole of I of one of the following compounds II:

a) of a carboxylic acid or of a carboxylic acid derivative of the general formula IIa

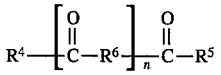

IIa where n is 0 or 1

$R^4$, $R^5$ are hydroxyl groups or $C_1$–$C_8$-alkoxy groups, which can be joined together in the case of n=0 to form a five- or six-membered ring, or chlorine or bromine and $R^6$ is an alkylene group having 1 to 50 carbon atoms which can be interrupted by one or more nonadjacent oxygen atoms, b) a carboxamide of the general formula IIb

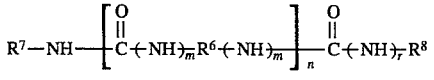

IIb where m, n and r are each 0 or 1

$R^7$ is hydrogen or a $C_1$–$C_4$-alkyl group and $R^8$ is hydrogen, a $C_1$–$C_{25}$-alkyl group, a $C_2$–$C_{25}$-alkenyl group or a phenyl radical which can carry $C_1$–$C_4$-alkyl groups, $C_1$–$C_4$-alkoxy groups and also fluorine, chlorine or bromine as substituents, c) an epihalohydrin in the general formula IIc

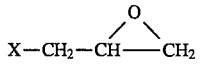

IIc where

X is chlorine or bromine, d) of a monofunctional compound of the general formula IId $$R^9—Y$$

IId where $R^9$ is a $C_1$–$C_{25}$-alkyl group, a $C_2$–$C_{25}$-alkenyl group or a phenyl radical which can carry $C_1$–$C_4$-alkyl groups, $C_1$–$C_4$-alkoxy groups and also fluorine, chlorine or bromine as substituents, and Y is isocyanate or one of the groups

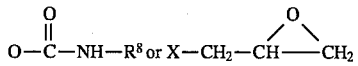

or e) of a bifunctional compound of the general formula IIe $$Z^1—R^{10}—Z^2 \qquad \text{IIe}$$

where $R^{10}$ is an alkylene groups having 1 to 50 carbon atoms which can be interrupted by one or more nonadjacent oxygen atoms and/or contain one or more nonvicinal hydroxyl groups, and $Z^1$ and $Z^2$ are each chlorine, bromine, isocyanate or one of the groups

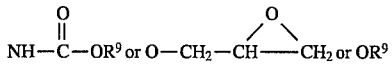

or of mixtures thereof, and c) 25 to 100 mol % per mole of I of a benzyl halide of the general formula III

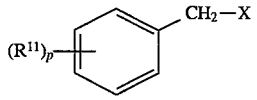

III where is from 0 to 2 and $R^{11}$ is a $C_1$–$C_4$-alkyl group, a $C_1$–$C_4$-alkoxy group, and X is chlorine.

The precondensates used for preparing the cationic resins can be obtained by heating the trialkanolamines I, in particular triethanolamine or triisopropanolamine $N[CH_2—CH(CH_3)—OH]_3$, in the presence of acidic catalysts, preferably phosphorous or hypophosphorous acid, at temperatures from 120° to 280° C. as described in EP-A 223 064. In departure from the process of this EP-A the reaction is advantageously discontinued distinctly below the gel point, by cooling, on attainment of a viscosity range from 5000 to 35,000 mPa·s, preferably from 10,000 to 25,000 mPa·s, for triethanolamine or from 100,000 to 600,000 mPa·s, preferably from 200,000 to 500,000 mPa·s, for triisopropanolamine or from 100,000 to 250,000 mPa·s for a cocondensate of preferably equimolar amounts of triethanolamine and triisopropanolamine (in each case measured in the undiluted state at 20° C.). For further crosslinking and/or incorporation of groups of different polarities into the chains which carry the alcohol functions and/or by quaternization with the central nitrogen atoms, the precondensates obtained are reacted with one or more compounds IIa to IIe. The amount of these compounds lies within the range from 1 to 30 mol %, preferably from 1 to 15 mol %, per mole of I.

Suitable compounds IIa to IIe are:

a) the defined carboxylic acids or their derivatives IIa where the radicals $R^4$ and $R^5$ are hydroxyl groups, $C_1$–$C_8$-alkoxy groups, preferably $C_1$–$C_4$-alkoxy groups, chlorine or bromine and suitable for the bridge member $R^6$ are in particular the groupings

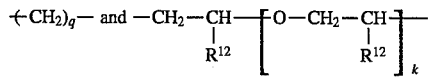

where q is from 1 to 50, preferably from 2 to 10, and k is from 0 to 24, preferably from 0 to 12, and $R^{12}$ is hydrogen, methyl or ethyl; preference is further given to unbranched bridge members $R^6$.

Examples of compounds IIa are:

α) carbonic acid derivatives (n=0), eg. dimethyl carbonate, diethyl carbonate, dipropyl carbonate, dibutyl carbonate, ethylene carbonate, 1,2-propylene carbonate, 1,3-propylene carbonate, 1,2-butylene carbonate, 1,3-butylene carbonate, 2,3-butylene carbonate, phosgene, monomethyl chlorocarbonate, monomethyl bromocarbonate, monoethyl chlorocarbonate and monoethyl bromocarbonate. Preference is given to cyclic carbonates, among which in particular ethylene carbonate and 1,3-propylene carbonate;

β) dicarboxylic acids (n=1, $R^4$=$R^5$=OH), eg. malonic acid, succinic acid, glutaric acid, adipic acid, pimelic acid, suberic acid, azelaic acid and sebacic acid;

γ) dicarboxylic acid derivatives (n=1; $R^4$, $R^5$= alkoxy, Cl, Br); suitable examples here are the dimethyl, diethyl, dipropyl and dibutyl esters and also the chlorides and bromides of the dicarboxylic acids listed under β);

b) the defined carboxamides IIb, of which there may be mentioned as examples:

α) monocarboxamides (n=r=o), eg. formamide, acetamide, propionamide, butyramide, benzamide and also the N-methyl, N-ethyl, N-propyl and N-butyl derivatives of these amides;

β) dicarboxamides (m=0, n=r=1), eg. malonamide, succinamide, glutaramide, adipamide, pimelamide, suberamide, azelaamide, sebacamide and also the N,N'-dimethyl, N,N'-diethyl, N,N'-dipropyl and N,N'-dibutyl derivatives of these diamides;

γ) ureas (n=0, r=1), eg. urea, N-methylurea, N-ethylurea, N-propylurea, N-butylurea, N,N'-dimethylurea, N,N'-diethylurea, N,N'-dipropylurea, N,N'-dibutylurea, N-(2-ethylhexyl)urea, N-isononylurea, N-isotridecylurea, N-laurylurea, N-myristylurea, N-palmitylurea, N-stearylurea, N-oleylurea, N-linolylurea, N-linolylurea, N-linolenylurea and N-phenylurea. Preference is given to monosubstituted ureas, and in particular to unsubstituted urea;

δ) bisureas (m=n=r=1), eg. methylenediurea, Ethylene-1,2-diurea, propylene-1,3-diurea, butylene- 1,4-diurea, pentamethylene-1,5-diurea, hexamethylene-1,6-diurea, di(2-ureidoethyl) ether, di(3-ureidopropyl) ether, ethylene glycol bis(2-ureidoethyl) ether, ethylene glycol bis(3-ureidopropyl) ether, diethylene glycol bis(2-ureidoethyl) ether, triethylene glycol bis(2-ureidoethyl) ether and tetraethylene glycol bis(2-ureidoethyl) ether. Preference is given to bisureas having an alkylene bridges $R^6$ with 4 to 10 carbon atoms and particular preference is given to hexamethylene-1,6-diurea;

c) an epihalohydrin IIc where X is chlorine or bromine. Preference is given to epichlorohydrin;

d) the defined monofunctional compounds IId, for which there may be mentioned as examples:

α) isocyanates, eg. methyl isocyanate, ethyl isocyanate, propyl isocyanate, butyl isocyanate, 2-ethylhexyl isocyanate, isononyl isocyanate, isotridecyl isocyanate, lauryl isocyanate, myristyl isocyanate, palmityl isocyanate, stearyl isocyanate, oleyl isocyanate, linolyl isocyanate, linolenyl isocyanate, phenyl isocyanate, o-, m- or p-chlorophenyl isocyanate and o-, m- or p-tolyl isocyanate;

β) urethanes, eg. methyl carbamate, ethyl carbamate, propyl carbamate, propyl carbamate, butyl carbamate and also the N-methyl, N-ethyl, N-propyl and N-butyl derivatives of these compounds;

γ) glycidyl ethers, eg. methyl glycidyl ether, ethyl glycidyl ether, propyl glycidyl ether, butyl glycidyl ether, 2-ethylhexyl glycidyl ether, isononyl glycidyl ether, isodecyl glycidyl ether, isotridecyl glycidyl ether, lauryl glycidyl ether, myristyl glycidyl ether, palmityl glycidyl ether, stearyl glycidyl ether, oleyl glycidyl ether, linolyl glycidyl ether, linolenyl glycidyl ether, cyclohexyl glycidyl ether, glycidyl ethers of $C_{13}$–$C_{15}$ oxo alcohol, $C_{12}$–$C_{14}$ fatty alcohol and also $C_{16}$–$C_{18}$ fatty alcohol and phenyl glycidyl ether;

e) the defined bifunctional compounds IIe where $R^{10}$ is an alkylene group having 1 to 50 carbon atoms, preferably having 2 to 26 carbon atoms, which can be interrupted by one or more nonadjacent oxygen atoms and/or contain one or more nonvicinal hydroxyl groups. Suitable for the bridge member $R^{10}$ are in particular the groupings $$(CH_2)_q \text{ and } -CH_2-\underset{\underset{R^{12}}{|}}{CH}-\left[O-CH_2-\underset{\underset{R^{12}}{|}}{CH}\right]_k-$$

where q is from 1 to 50, preferably from 2 to 10, k is from 0 to 24, preferably from 0 to 12, and $R^{12}$ is hydrogen, methyl or ethyl; preference is further given to unbranched bridge members $R^{10}$.

Examples of compounds IIe are:

α) dichlorides or dibromides, eg. methylene chloride, 1,2-dichloroethane, 1,3-dichloropropane, 1,4-dichlorobutane, 1,5-dichloropentane, 1,6-dichlorohexane, di[2-chloroethyl] ether, di[3-chloropropyl] ether, ethylene glycol-bis[2-chloroethyl] ether, ethylene glycol bis[3-chloropropyl] ether, diethylene glycol bis[2-chloroethyl] ether, triethylene glycol bis[2-chloroethyl] ether, 1,3-dichloro-2-propanol, di[3-chloro-2-hydroxypropyl] ether, ethylene glycol bis [3-chloro-2-hydroxypropyl] ether, diethylene glycol bis[3-chloro-2-hydroxypropyl] ether and triethylene glycol bis[3-chloro-2-hydroxypropyl] ether, neopentylenebis[3-chloro-2-hydroxypropyl] ether or the corresponding bromine compounds;

β) diisocyanates, eg. ethylene 1,2-diisocyanate, propylene 1,3-diisocyanate, butylene 1,4-diisocyanate, pentamethylene 1,5-diisocyanate, hexamethylene 1,6-diisocyanate, di(2-isocyanatoethyl) ether, di(3-isocyanatopropyl) ether, ethylene glycol bis(2- isocyanatoethyl) ether, ethylene glycol bis(3- isocyanatopropyl) ether, diethylene glycol bis(2- isocyanatoethyl) ether, triethylene glycol bis(2-isocyanatoethyl) ether and tetraethylene glycol bis(2- isocyanatoethyl) ether;

γ) bisurethanes, eg. the dimethyl esters, diethyl esters, dipropyl esters and dibutyl esters of ethylene-1,2-dicarbamic acid, propylene-1,3-dicarbamic acid, butylene- 1,4-dicarbamic acid, pentamethylene-1,5-dicarbamic acid, hexamethylene-1,6-dicarbamic acid, di[2-(carboxyamino)ethyl] ether, di[3-(carboxyamino)ethyl] ether, di[-(carboxyamino)propyl] ether, ethylene glycol bis[2-(carboxyamino)ethyl] ether, ethylene glycol bis[3-(carboxyamino)propyl] ether, diethylene glycol bis[2-(carboxyamino)ethyl] ether, triethylene glycol [2-(carboxyamino))ethyl] ether and tetraethylene glycol bis[2-(carboxyamino-)ethyl] ether;

δ) bisglycidyl ethers, eg. ethylene glycol bisglycidyl ether, 1,3-propanediol bisglycidyl ether, 1,4-butanediol bisglycidyl ether, 1,5-pentanediol bisglycidyl ether, 1,6-hexanediol bisglycidyl ether, diethylene glycol bisglycidyl ether, di[3-(glycidyloxy)propyl] ether, triethylene glycol bisglycidyl ether, ethylene glycol bis[3-glycidyloxy)propyl] ether, tetraethylene glycol bisglycidyl ether, pentaethylene glycol bisglycidyl ether, hexaethylene glycol bisglycidyl ether and neopentylene glycol bisglycidyl ether;

ε) γ-alkoxy- or γ-aryloxy-propylene halohydrides, eg. 3-chloro-2-hydroxypropyl methyl ether, 3-chloro-2-hydroxypropyl ethyl ether, 3-chloro-2-hydroxypropyl propyl ether, 3-chloro-2-hydroxylpropyl butyl ether, 3-chloro-2-hydroxypropyl 2-ethylhexyl ether, 3-chloro-2-hydroxypropyl isononyl ether, 3-chloro-2-hydroxylpropyl isotridecyl ether, 3-chloro-2-hydroxypropyl lauryl ether, 3-chloro-2-hydroxypropyl myristyl ether, 3-chloro-2-hydroxypropyl palmityl ether, 3-chloro-2-hydroxylpropyl stearyl ether, 3-chloro- 2-hydroxypropyl olelyl ether, 3-chloro-2-hydroxypropyl linolyl ether, 3-chloro-2-hydroxypropyl linolenyl ether and 3-chloro-2-hydroxypropyl phenyl ether or the corresponding bromine compounds.

The reaction of the precondensate of triethanolamine takes place preferably with a urea IIb (n=0, r=1), a bisurea IIb (m=n=r=1) or a cyclic carbonate IIa ($R^4$—$R^5$=0-alkylene- 0, n=0) at temperatures from 100° to 210° C., preferably 140° to 200° C., without solvent to a viscosity from 20,000 to 300,000 mPa·s, preferably 28,000 to 150,000 mPa·s, and with an epihalohydrin IIc without use of a solvent at temperatures from 40° to 150° C., preferably 60° to 130° C., or in at least 40% strength by volume aqueous, if desired even aqueous-alcoholic, solution at temperatures from 40° to 100° C. to a viscosity of an 80% strength by weight aqueous solution at 20° C. from 12,000 to 40,000 mPa·s, preferably 15,000 to 36,000 mPa·s.

The reaction of the precondensate of triisopropanolamine takes place preferably with a urea IIb (n=0, r=1), a bisurea IIb (m=n=r=1) or a cyclic carbonate IIa ($R^4$—$R^5$=0-alkylene-0, n=0) at temperatures from 100° to 210° C., preferably from 140° to 200° C., without solvent to a viscosity of more than 500,000 mPa·s and with an epihalohydrin IIc without use of a solvent at temperatures from 40° to 150° C., preferably 60° to 130° C., or in at least 40% strength by volume aqueous, if desired or even aqueous-alcoholic, solution at temperatures at from 40° to 100° C.

The quaternary condensation products described above as preferred are also used in the dyeing process of the invention preferably in the 1st treatment bath.

It is also possible to use benzyl chloride-quaternized condensation products of piperazine and epichlorohydrin. Condensation products of this kind are known for example from "Die neuesten Fortschritte in der Anwendung der Farbstoffe" (volume 2, page 96f) by L. Diserens, [2nd edition, Verlag Birkhäuser Basle 1949]. The piperazine and epichlorohydrin are condensed in a molar ratio of (0.5–1):(1–0.5), preferably in the molar ratio of 1:1. The condensation prod then quaternized by reaction with benzyl chloride. The quaternized condensation products have in the form of a 50% strength aqueous solution viscosities from 100 to 1000 Pa·s, preferably from 200 to 500 mPa·s (measured at 20° C.).

The concentration of the quaternized condensation products in the aqueous liquor is at least 5 g/l. It is also possible to use mixtures of the various condensation products. The concentrations of quaternized condensation products can be up to 100 g/l or even higher and is preferably within the range from 15 to 50 g/l. The quaternized condensation products are soluble in the aqueous liquor. The temperature of the aqueous liquor to which the textile materials are introduced for treatment can be varied within a wide range. Suitable are temperatures from 15° to 95° C. The preferred treatment temperatures are 20° to 35° C.

The aqueous liquor as component (ii) 0.02 to 1 g/l of a phosphoric triester whose alcohol component is derived from aliphatic, aryl-substituted aliphatic alcohols, phenols or alkyl-substituted phenols having in each case 6 to 18 carbon atoms in the alcohol or phenol radical. Suitable phosphoric triesters are for example triisobutyl phosphate, tri(2-ethylhexyl) phosphate, trihexyl phosphate, tridecyl phosphate, tridodecyl phosphate, tri-tert-butylphenyl phosphate, tridodecylphenyl phosphate and mixtures of at least 2 of the phosphates mentioned.

In addition to compounds (I) and (II), the aqueous liquor may also contain 0.1 to 1 g/l of an nonionic wetting agent.

The surface or ring dyeing of the cellulose fibers is carried out continuously by guiding textile materials containing or consisting of cellulose fibers, for example on an indigo dyeing machine, initially through a bath containing the compounds (i) and (ii) in the above-specified amounts. The textile materials are preferably in the form of yarn which, following the treatment with the afore-described aqueous liquor, is squeezed off and guided into another bath and dyed therein with reactive dyes in an aqueous medium.

Suitable for the process of the invention are all water-soluble reactive dyes. These dyes are described in detail in the Colour Index, 3rd edition, published by the Soc. of Dyes and Colorists, volume 3, 6 to 8 and in the Additions and Amendments No. 65 to 81. The most important feature of this class of dyes is the reactive group via which the chromophoric part of the dye molecule is bonded to the substrate to be dyed. Suitable reactive groups are for example vinyl sulfone, beta-sulfatoethyl sulfone, beta-chloroethyl sulfone and beta-dialkylaminoethyl sulfone groups or heterocycles substituted by 1 to 3 halogen atoms, such as triazine, pyrdazine, pyridazone, quinoxaline and pyrimidine. The reactive dyes can contain one or more reactive groups. The chromophoric part is primarily derived from azo compounds, disazo compounds, metal complexes of the azo dyes or disazo dyes, anthraquinone derivatives, formazans and phthalocyanines.

The dyeing of the cellulose fibers with reactive dyes takes place according to known processes, for example within the temperature range from 20° to 95° C.

The textile material coming out of the dyebath is then treated continuously with an alkaline liquor, through which it is guided continuously, to fix the reactive dyes. The fixing and finishing of the dyeing is likewise effected continuously and in conventional manner. To finish the dyeing the textile material is preferably guided through an aqueous liquor containing 0.5 to 2 g/l of a washing and/or dispersing agent. Subsequently the material is rinsed one or more times with water.

In the dyed cellulose textile materials obtained, the individual fibers have merely been dyed at the surface and not in the interior. The individual cellulose fibers have thus been dyed not over the entire cross-section of the fiber but only in the outer regions. This is therefore referred to as a ring dyeing. The textile materials thus dyed can be used to achieve the wash-down effects known from indigo. The process of the invention is a simple method for dyeing cellulose fiber textile materials on dyeing ranges which are usually used for indigo dyes and dyeings with any desired reactive dyes are obtained. The textile materials thus dyed can be used with advantage to manufacture jeans fabrics in virtually any shade, which, after the appropriate treatment, exhibit wash-down effects. unless otherwise stated, the percentages in the Examples are by weight.

EXAMPLES

Cationic Compound I

Aqueous solution of a polyquaternary compound obtained by the method of Synthesis Example 5 of U.S. Pat. No. 5,015,754 by condensation of a triethanolamine precondensate with 5 mol % of urea and subsequent quaternization with 90 mol % of benzyl chloride.

Cationic Compound II

Condensation product of piperazine and epichlorohydrin in the molar ratio 1:1 and quaternization with 1.4 mol of benzyl chloride, based on piperazine. The viscosity of the 47% strength aqueous solution is 325 mPa·s.

Phosphoric ester I

Neutral phosphoric triester of an aliphatic alcohol having 8 carbon atoms.

EXAMPLE 1

A graystate cotton yarn (12 Nm/l) is guided for 10 seconds through a liquor containing 4 parts of the cationic compound I, 0.03 part of the phosphoric ester I.

The cotton yarn is squeezed off to about 40% liquor pickup and guided for one minute through an air passage. In the second liquor trough, through which the yarn is dipped wet on wet, again for 10 seconds, contains 3 parts of the reactive dye C.I. Reactive Blue 21 and 3 parts of NaCl. The liquor addition after the padding was about 25%. This was followed by a one-minute air passage. In the third liquor trough the dye was fixed by a hot alkaline solution at 95° C. The fixing liquor contained 15 parts by volume of NaOH 38° Bé and 20 parts of NaCl. After the squeezing off of the yarn there followed a two-fold rinse with water (room temperature), each time for 10 seconds, and subsequent padding, a soaping process with 0.1 part of a commercial washing agent at the boil for 10 seconds with subsequent squeezing off of the warp yarn. Thereafter the yarn was rinsed once more and subsequently dried.

The result obtained was a turquoise-colored yarn in which the cellulose fibers exhibit very good ring dyeing which is indispensable for the denim article with wash-down effects. The use fastness properties achieved correspond to those which are customarily obtained for a denim article with wash-down effects.

EXAMPLE 2

A graystate cotton yarn (12 Nm/l) is guided for 10 seconds through a liquor containing 4 parts of the cationic compound I, 0.03 part of the phosphoric ester I and 0.05 part of a commercial nonionic wetting agent.

The cotton yarn is squeezed off to about 40% liquor pickup and guided for one minute through an air passage. In the second liquor trough, through which the yarn is dipped wet on wet, again for 10 seconds, contains 3 parts of the reactive dye C.I. Reactive Blue 21 and 3 parts of NaCl. The liquor addition after the padding was about 25%. This was followed by a one-minute air passage. In the third liquor trough the dye was fixed by a hot alkaline solution at 95° C. The fixing liquor contained 15 parts by volume of NaOH 38° Bé and 20 parts of NaCl. After the squeezing off of the yarn there followed a two-fold rinse with water (room temperature), each time for 10 seconds, and subsequent padding, a soaping process with 0.1 part of a commercial washing agent at the boil for 10 seconds with subsequent squeezing off of the warp yarn. Thereafter the yarn was rinsed once more and subsequently dried.

The result obtained is a turquoise-colored yarn in which the individual cellulose fibers exhibit very good ring dyeing. Compared with Example 1 the depth of penetration of the dye into the textile material is greater. This is due to the presence of wetting agent in the 1st treatment bath.

The use fastness properties achieved correspond to those which are customary for a denim article with wash-down effects.

EXAMPLE 3

A graystate cotton yarn (12 Nm/l) is guided for 10 seconds through a liquor containing 4 parts of the cationic compounds II and 0.03 part of the phosphoric ester I.

The cotton yarn is squeezed off to about 40% liquor pickup and guided for one minute through an air passage. In the second liquor trough, through which the yarn is dipped wet on wet, again for 10 seconds, contains 3 parts of the reactive dye C.I. Reactive Red 24 and 3 parts of NaCl. The liquor addition after the padding was about 25%. This was followed by a one-minute air passage. In the third liquor trough the dye was fixed by a hot alkaline solution at 95° C. The fixing liquor contained 15 parts by volume of NaOH 38° Bé and 20 parts of NaCl. After the squeezing off of the yarn there followed a two-fold rinse with water (room temperature), each time for 10 seconds, and subsequent padding, a soaping process with 0.1 part of a commercial washing agent at the boil for 10 seconds with subsequent squeezing off of the warp yarn. Thereafter the yarn was rinsed once more and subsequently dried.

The result obtained is a red yarn in which the individual cellulose fibers exhibit very good ring dyeing. The use fastness properties achieved correspond to those which are customary for a denim article with wash-down effects.

We claim:

1. A process for the continuous production of surface dyeings on cellulose fiber textile materials, which comprises:

a) initially treating the textile materials with an aqueous liquor containing:

i) from about 5 g/l to about 100 g/l of at least one compound selected from the group consisting of benzyl halide quaternized condensation products of precondensates of trialkanolamines with ureas, cyclic carbonates and epihalohydrins and condensation products of piperazine with epichlorohydrin; and ii) from about 0.02 g/l to about 1 g/l of a phosphoric triester whose alcohol component derives from aliphatic, aryl-substituted aliphatic alcohols, phenols or alkyl-substituted phenols having in each case 6 to 18 carbon atoms in the alcohol or phenol radical; and b) dyeing said treated textile materials in another bath containing reactive dyes in an aqueous medium and then fixing the dyes by treatment with an alkaline liquor.

2. The process of claim 1, wherein the textile materials initially treated with said aqueous liquor are treated at a temperature of from 15° C. to 95° C.

3. The process of claim 1, wherein said aqueous liquor further comprises 0.01 to 1 g/l of a nonionic wetting agent.

4. The process of claim 1, wherein from about 15 to 50 g/l of constituent i) of said aqueous liquor is used.

5. The process of claim 1, wherein said treatment of said textile materials with said aqueous liquor is effected at from 20° C. to 35° C.

6. The process for claim 1, wherein said dyeing step b) is effected at from 20° C. to 95° C.

7. The process of claim 1, wherein said benzyl halide has the formula:

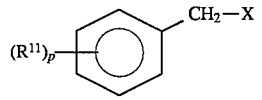

wherein p is from 0 to 2, and $R^{11}$ is $C_1$–$C_4$ -alkyl, $C_1$–$C_4$-alkoxy, X is chlorine.

8. The process of claim 1, wherein said trialkanolamines have the formula:

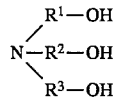

wherein $R_1$, $R_2$ and $R_3$ are the same or different and are each 1,2-alkylene groups having 2 to 4 carbon atoms.

9. The process for claim 1, wherein said ureas are selected from the group consisting of urea, N-methylurea, N-ethylurea, N-propylurea, N-butylurea, N,N'-dimethylurea, N,N'-diethylurea, N,N'-dipropylurea, N,N'-dibutylurea, N-(2-ethylhexyl) urea, N-isononylurea, N-isotridecylurea, N-laurylurea, N-myristylurea, N-palmitylurea, N-stearylurea, N-oleylurea, N-linolylurea, N-linolenylurea and N-phenylurea.

10. The process of claim 1, wherein said cyclic carbonates are selected from the group consisting of ethylene carbonate and 1,3-propylene carbonate.

11. The process of claim 1, wherein said phosphoric triester is selected from the group consisting of triisobutyl phosphate, tri-(2-ethylhexyl) phosphate, trihexyl phosphate, tridecyl phosphate, tridodecyl phosphate, tri-tert-butylphenyl phosphate, tridodecylphenyl phosphate and mixtures thereof.

* * * * *